US008602952B1

(12) United States Patent
Cruz

(10) Patent No.: US 8,602,952 B1
(45) Date of Patent: Dec. 10, 2013

(54) TELESCOPING PRE-TENSIONED RESISTANCE EXERCISE ASSEMBLY

(76) Inventor: Christian Cruz, Pembroke Pines, FL (US)

( * ) Notice: Subject to any disclaimer, the term of this patent is extended or adjusted under 35 U.S.C. 154(b) by 360 days.

(21) Appl. No.: 13/164,743

(22) Filed: Jun. 20, 2011

Related U.S. Application Data

(60) Continuation-in-part of application No. 12/757,022, filed on Apr. 8, 2010, now Pat. No. 7,963,893, which is a division of application No. 12/113,933, filed on May 1, 2008, now Pat. No. 7,695,413.

(60) Provisional application No. 60/792,189, filed on Sep. 13, 2007, provisional application No. 60/951,954, filed on Jul. 26, 2007, provisional application No. 60/917,310, filed on May 10, 2007.

(51) Int. Cl.
*A63B 21/02* (2006.01)

(52) U.S. Cl.
USPC ..... 482/126; 482/121; 482/122

(58) Field of Classification Search
USPC ..... 482/121–130, 140, 91, 92, 907–908, 482/139, 44–51, 148
See application file for complete search history.

(56) References Cited

U.S. PATENT DOCUMENTS

| | | | | |
|---|---|---|---|---|
| 3,345,067 | A | 10/1967 | Smith | |
| 5,484,368 | A * | 1/1996 | Chang | 482/122 |
| 7,238,144 | B2 | 7/2007 | Ferrara | |
| 7,695,413 | B1 * | 4/2010 | Cruz et al. | 482/126 |
| 7,963,893 | B1 * | 6/2011 | Cruz et al. | 482/126 |

* cited by examiner

*Primary Examiner* — Oren Ginsberg
*Assistant Examiner* — Rae Fischer
(74) *Attorney, Agent, or Firm* — Allen D. Hertz, P.A.; Allen D. Hertz

(57) ABSTRACT

An elastic resistance band that is fabricated by placing two end couplers on each end of a section of elastic resistance material. A pre-tensioned force is applied by incorporating a rigid tensioning member between the two end couplers of the resistance band. The resistance material is stretched during the assembly process, placing the material in a pre-tensioned state. By pre-tensioning the material, the resistance band then provides a more linear force to the end user. The rigid tensioning member is a telescoping assembly, wherein the resistance band is placed within an interior section of the telescoping assembly. The telescoping assembly comprises a plurality of telescoping tubular members slideably engaged with each other. An expansion end wall aperture and an interior surface of a groove are provided to retain an axial linear motion between telescoping tubular members.

20 Claims, 20 Drawing Sheets

TELESCOPING PRE-TENSIONED RESISTANCE EXERCISE ASSEMBLY

RELATED US PATENT APPLICATIONS

This is a Continuation-In-Part Patent Application claiming the benefit of co-pending Non-Provisional application Ser. No. 12/757,022 filed on Apr. 8, 2010, which will be issuing as U.S. Pat. No. 7,963,893 on Jun. 21, 2011; which is a Divisional Application of co-pending Non-Provisional application Ser. No. 12/113,933 filed on May 1, 2008, issued as U.S. Pat. No. 7,695,413 on Apr. 13, 2010; which claims the benefit of Provisional Application 60/917,310 filed on May 10, 2007, Provisional Application 60/951,954 filed on Jul. 26, 2007, and Provisional Application 60/972,189 filed on Sep. 13, 2007, all of which are incorporated by reference in their entireties herein.

FIELD OF THE INVENTION

The invention relates to a resistance exercise band, more specifically, a pre-tensioned resistance exercise band encapsulated within a telescoping body, wherein the assembly provides a linear force curve in response to an applied tensile force.

BACKGROUND OF THE INVENTION

Exercise is a task that people should endure on a regular basis. With people's busy schedules, any simplification to the exercise routines aids helps entice people to exercise.

Resistance exercise bands provide a user the ability to exercise using a resistive load (force) without the requirement of heavy weights. Resistance exercise bands are typically stretched between two points to simulate dead weights' resistance. They are used across the complete spectrum of exercises to provide resistance while doing curls, bench pressing, butterfly's, leg presses and many other exercises. One such advantage of resistance bands would be for a person who travels. Another such advantage of resistance bands would be the cost and weight of an exercise machine when compared to those utilizing lead (or other) weights. Another such advantage is the cost effectiveness compared to a gym membership. Yet, another advantage is the convenience of resistance bands, wherein the user can exercise quickly, easily and wherever desired.

Currently available elastic resistance bands are tubular with a cylindrical cross section having a hollow center section. To provide a variety of resistive ranges, current elastic resistance bands have various cross sections with varying outer diameters, wall thickness, and inner diameters coupled with different rubber durameters.

Typical elastic resistance bands generate a non-linear resistive force whose unit force/distance changes dramatically as the band is elongated. The resulting force distance curve provides regions where the net work and feel of the resistance differs dramatically from exercising with free weights.

What is desired is a means for providing a user the ability to replicate the feel and net workout from exercising with free weights, while using resistance exercise bands.

SUMMARY OF THE PRESENT INVENTION

A first aspect of the present invention is a resistance exercise band, which provides a linear resistance curve.

Yet, another aspect is an elastic resistance band comprising a rigid material placed between two connecting ends of the elastic resistance band.

Yet, another aspect is an elastic resistance band comprising a rigid material placed between two connecting ends of the elastic resistance band, wherein the resistance band material is placed into a pre-tensioned state.

Yet, another aspect is an elastic resistance band comprising a rigid material placed between two connecting ends of the elastic resistance band, wherein the resistance band material is placed into a pre-tensioned state, applying a force against a force receiving member located on each opposing end of the elastic resistance band material.

Yet, another aspect is a force receiving member located at least partially internal to the elastic resistance band and at each opposing end of the elastic resistance band material.

Yet, another aspect is a force receiving member located at least partially external to the elastic resistance band and at each opposing end of the elastic resistance band material.

Yet, another aspect is an elastic resistance band comprising a material placed in a center of a hollow, cylindrical elastic resistance band cross section, wherein said material placed in said center is a non-compressible solid material.

Yet, another aspect is an elastic resistance band placing the cylindrical elastic resistance band material within a tubular, non-compressible solid material.

Yet, another aspect utilizes a non-elastic member consisting of two end points, each end point fixed at the respected end of a section of the elastic resistance band.

Yet, another aspect utilizes a non-elastic member that is longer than the respected section of the elastic resistance band.

Yet, another aspect utilizes a plurality of sections of elastic resistance band material; the plurality of sections being coupled in series or end-to-end.

Yet, another aspect utilizes a plurality of sections of elastic resistance band material; the plurality of sections being coupled in parallel.

Yet, another aspect utilizes a plurality of sections of elastic resistance band material; at least one end comprising a band coupling loop.

Yet, another aspect utilizes a plurality of sections of elastic resistance band material; both ends comprising the band coupling loop.

Yet, another aspect provides an embodiment of an elastic resistance band having a handle at each of the opposing ends.

Yet, another aspect provides an embodiment of an elastic resistance band having a handle at a first end and at least one fastening feature at an opposing end.

Yet, another aspect provides an embodiment of an elastic resistance band having a handle at a first end and two fastening features at an opposing end.

Yet, another aspect provides fastening features that are J hooks.

Yet, another aspect provides fastening features that are spring locking clips.

Yet, another aspect provides an embodiment utilizing a non-elastic belting material comprising a plurality of fastening feature coupling members distributed at least partially along the length of the belting material.

Yet, another aspect provides an embodiment utilizing a non-elastic belting material comprising at least two rows of fastening feature coupling members distributed at least partially along the length of the belting material.

Yet, another aspect provides an embodiment incorporating a working loop into the non-elastic belting material wherein the user can secure the working loop around the user's foot, a door, or other object.

Yet, another aspect provides an embodiment of an elastic resistance band having a handle at a first end and plurality of flanges or rings distributed towards the opposing end of the elastic resistance band.

Yet, another aspect utilizes at least one of a split ring, a carbineer, a spring sleeve, a spring clip, and the like for coupling at least two pre-tensioned resistance band assemblies.

Yet, another aspect incorporates a telescoping external assembly. The telescoping assembly applies a pre-tensioning force to the resistive band material when the telescoping assembly is in a collapsed configuration.

Yet, another aspect attaches a band coupling member to at least one end of the telescoping external assembly.

Yet, another aspect utilizes an interior surface of a groove upon an exterior member of the telescoping assembly as a guide for an adjacent interior member of the telescoping assembly during extension and contraction motions.

Yet, another aspect utilizes a peripheral surface of an expansion end wall aperture of the exterior member of the telescoping assembly as a guide for the adjacent interior member of the telescoping assembly during extension and contraction motions.

Yet, another aspect incorporates a retention flange formed proximate an end wall of the interior member of the telescoping assembly limits an extension motion, the retention flange abuts an interior surface of the groove within the adjacent exterior member of the telescoping assembly. An exterior surface of the retention flange may be sized to slide against an interior surface of the adjacent exterior member of the telescoping assembly.

These and other aspects, features, and advantages of the present invention will become more readily apparent from the attached drawings and the detailed description of the preferred embodiments, which follow.

BRIEF DESCRIPTION OF THE DRAWINGS

For the purpose of initially illustrating the invention, the specification presents drawings, flow diagrams, and embodiments that are presently preferred as well as alternates. It should be understood, however, that the invention is not limited to the specific instrumentality and methods disclosed herein. It can be recognized that the figures represent a layout in which persons skilled in the art may make variations therein. In the drawings.

Like reference numerals refer to like parts throughout the several views of the drawings.

DETAILED DESCRIPTION OF THE DRAWING

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
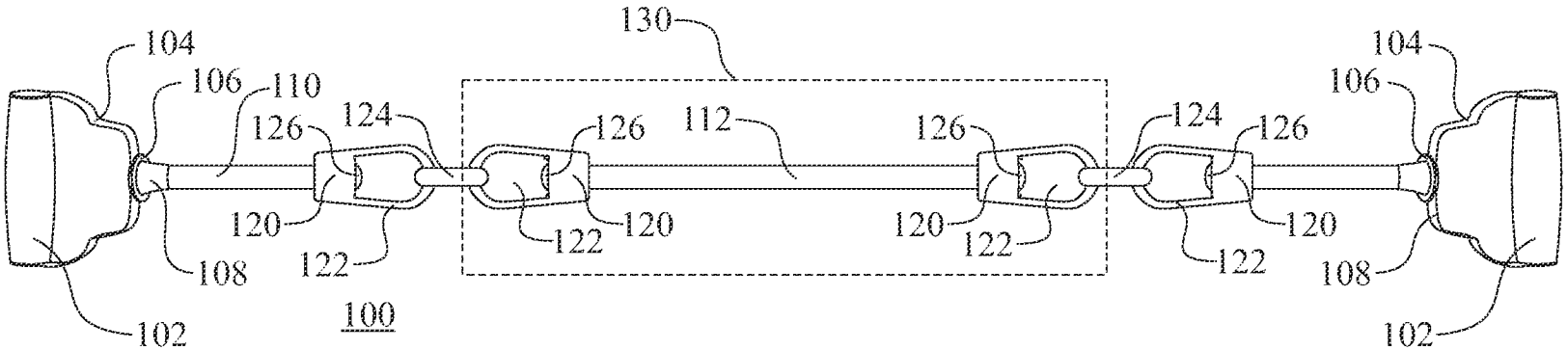
FIG. 1 presents a side view of an exemplary linear resistance exercise band.
Figure 2:
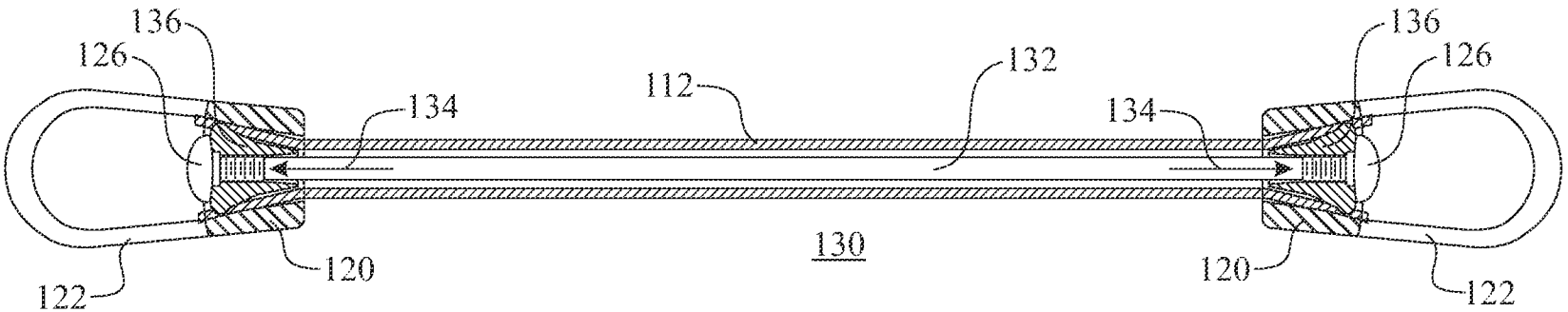
FIG. 2 presents a cross sectional view of the exemplary linear resistance exercise band originally introduced in FIG. 1, the section being taken through a longitudinal axis of the band.
Figure 3:
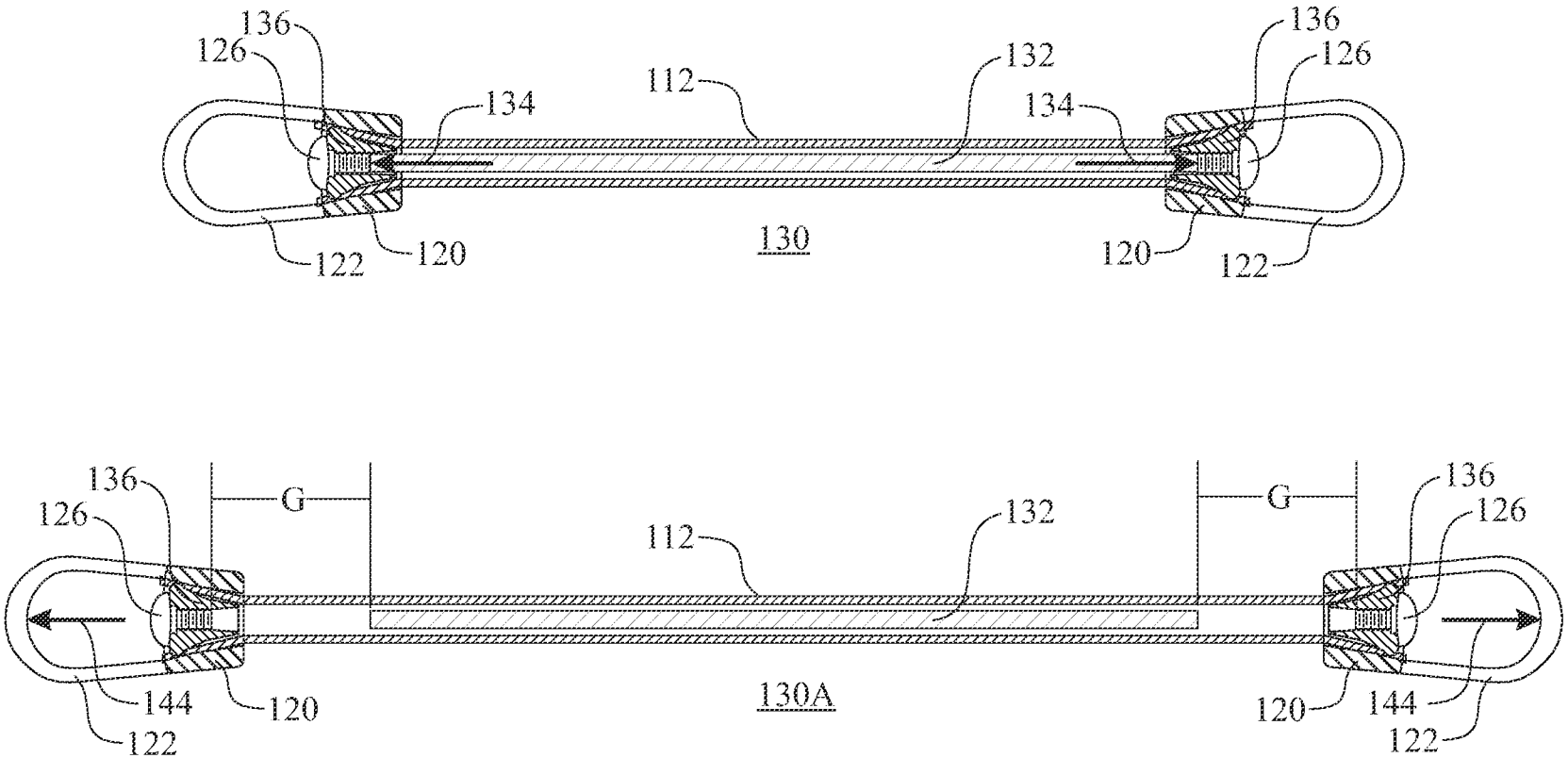
FIG. 3 presents a cross sectional view of the linear resistance exercise band originally introduced in FIG. 1, the section being through the longitudinal axis of the band presenting the band in both a normal state and a stretched state.
Figure 4:
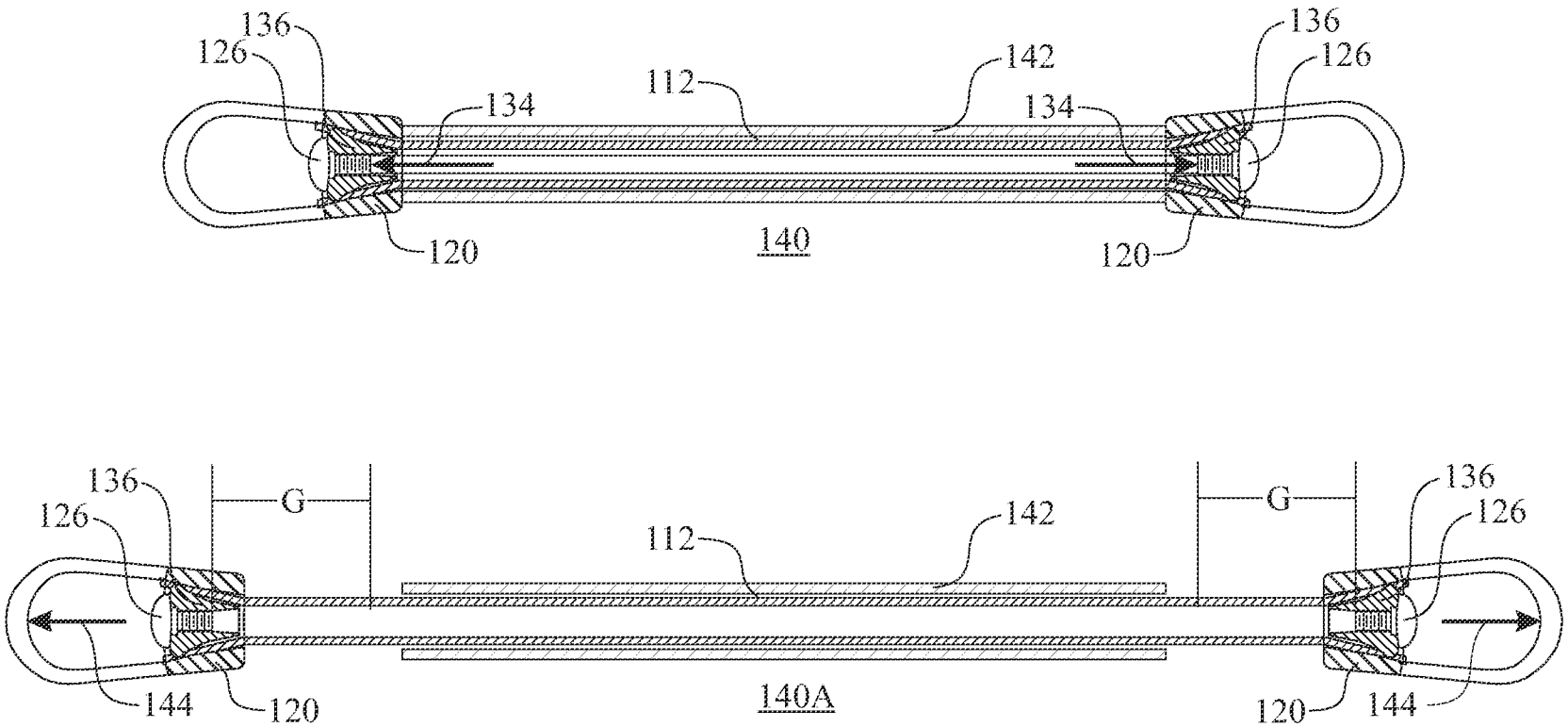
FIG. 4 presents a cross sectional view of said linear resistance exercise band utilizing an externally assembled rigid pre-tensioning member, presenting the band in both a normal state and a stretched state.

A first exemplary linear resistance exercise band 100 is presented in FIGS. 1 through 4. A complete linear resistance exercise band 100 is best illustrated in FIG. 1. A sectional view about the centerline of a pre-tensioned resistance band assembly 130 is presented in FIG. 2. A section of pre-tensioned resistance band assembly 130 shown in a relaxed state and pre-tensioned resistance band assembly 130A is shown in an expanded state in FIG. 3. An alternate embodiment of the linear resistance exercise band, utilizing externally assembled external tension tube 142; presents a section of externally supported pre-tension resistance band assembly 140 shown in a relaxed state and externally supported pre-tension resistance band assembly 140A is shown in an expanded state in FIG. 4.

The linear elastic resistance band 100 consists of at least one band handle 102 assembled to the linear elastic resistance band 100 via a band handle strap 104 and a band handle fastener 108. The handle assembly can be reinforced via the inclusion of a band handle reinforcement 106. The handle assembly can be secured to a first end of a section of non-linear band section 110. A band coupling member 120 is secured to the opposing end of the section of non-linear band section 110. The band coupling member 120 can be of any shape and design determined acceptable by the designer. In the exemplary embodiment, the band coupling member 120 includes a band coupling loop 122 providing the user with a feature for coupling a plurality of elastic band sections. In the exemplary embodiment, the band coupling member 120, the band coupling member 120 has a tapered internal cavity for receiving a tension plug 126. The elastic band material would be placed between the cavity within the band coupling member 120 and the tension plug 126, preferably folded in a manner that doubles the thickness of the elastic material. A tension plug 126 is placed in the end of the band assembly plug 136 as a mechanism for receiving forces applied by a tension rod 132. In an alternate embodiment, the tension rod 132 (which is placed within a hollowed section of the linear elastic band section 112) is replaced by an external tension tube 142. The external tension tube 142 is tubular in shape allowing the linear elastic band section 112 to be placed within a hollowed section of the external tension tube 142. The external tension tube 142 would abut the respective end of each band coupling member 120. This allows the elastic band section 112 to be of a solid material, including rubber, silicone, and composites such as a bungee cord. During assembly, the linear elastic band section 112 would be stretched, utilizing the tension rod 132 or external tension tube 142 presetting a tension generating force 134 to the linear elastic band section 112. The band section 130, 140 would be stretched as stretched band 130A, 140A by applying a tension force 144. The elastic band material has a force—distance curve that includes an inflection point, where the slope changes. The present invention utilizes that property and applies a pre-set tension to the material. The tension takes the material to the inflection point; thus, any additional stretch is found to be linear.

Figure 5:
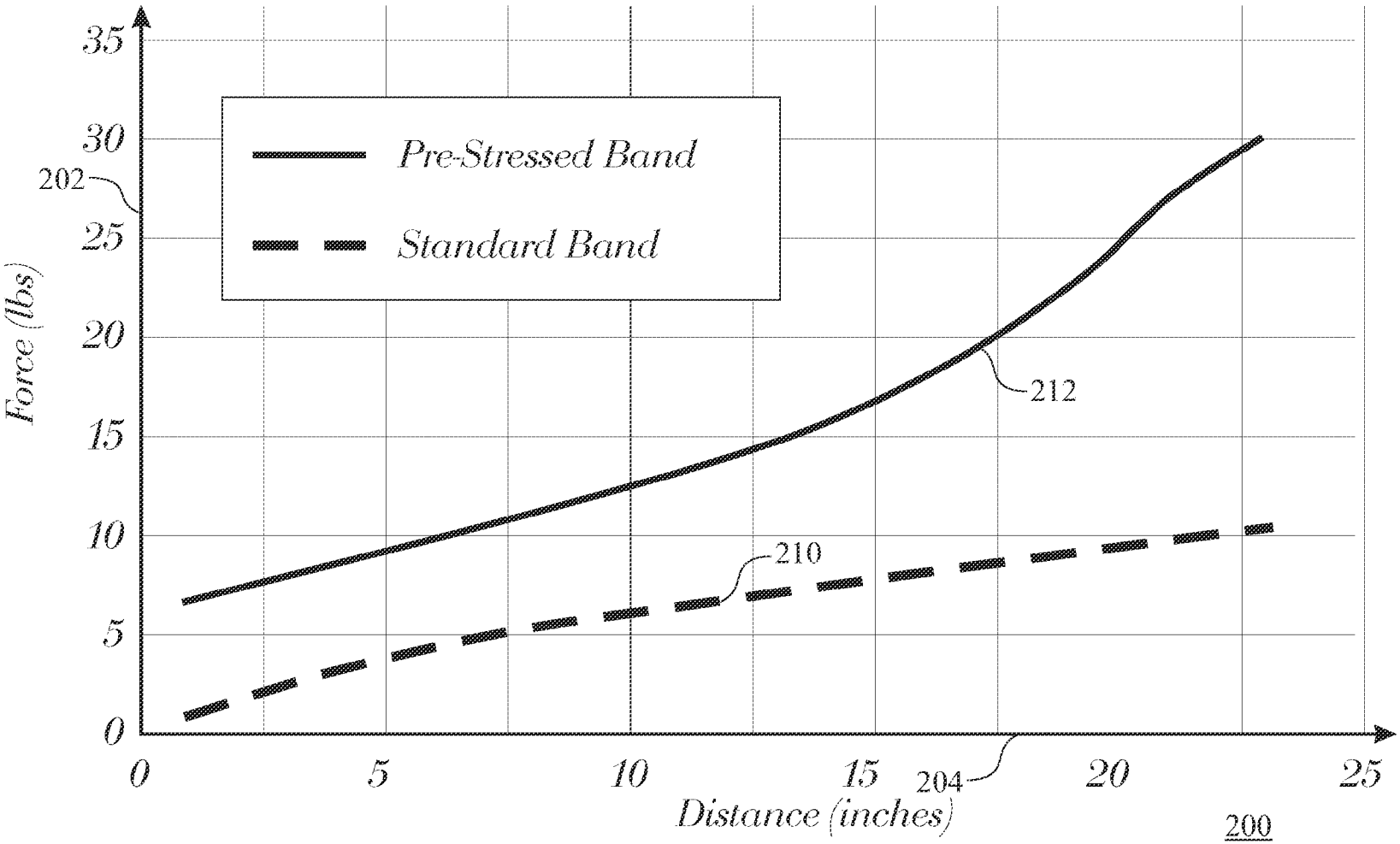
FIG. 5 presents an Force-Distance chart comparing a standard exercise band to a linear resistance exercise band.

A Force-Distance chart 200 is illustrated in FIG. 5. The Force—Distance chart 200 charts a force axis 202 vs. a distance axis 204. The resistive force provided by the band is charted along the force axis 202. The total distance in which the band is stretch is charted along the distance axis 204. The standard band is characterized via a standard resistance band curve 210. The pre-stressed band is characterized via a pre-stressed resistance band curve 212. The area under each respective curve is equal to the work performed for each repetition while exercising. The work performed by pre-stressed resistance band curve 212 is double the work performed by standard resistance band curve 210. The area under the curve for pre-stressed resistance band curve 212 represents the equivalent workout and approximate feel of an exercise using a 151*b* free weight.

Figure 6:
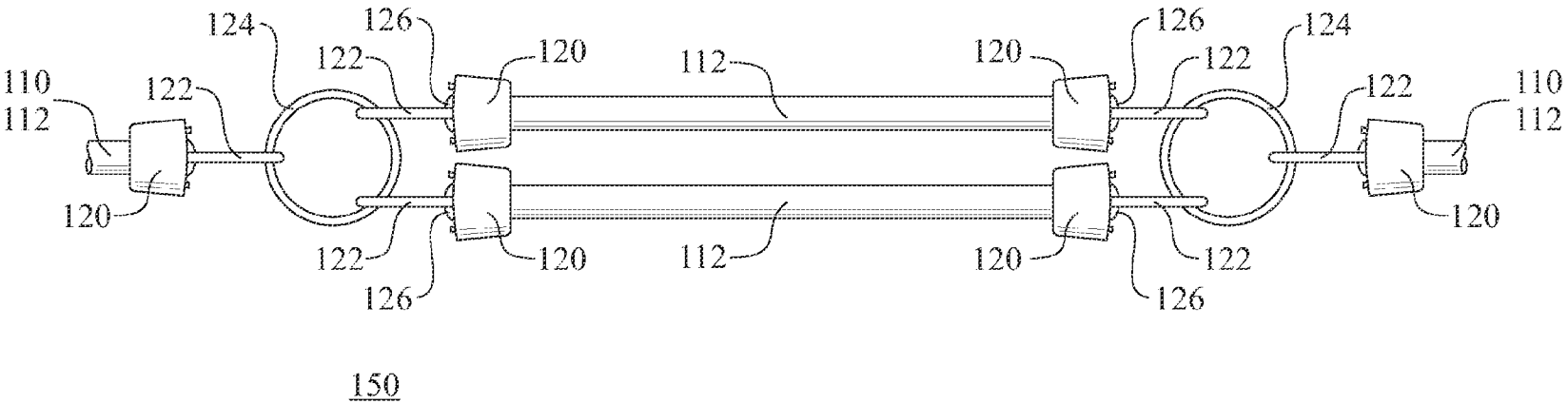
FIG. 6 presents a side view of an exemplary parallel linear resistance exercise band configuration.
Figure 7:
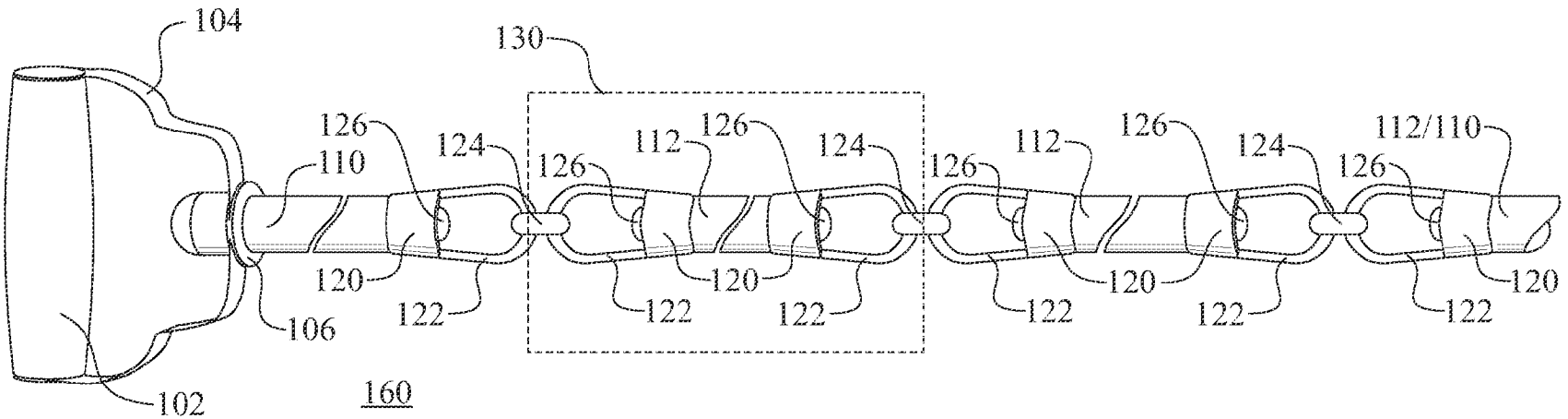
FIG. 7 presents a side view of an exemplary serial linear resistance exercise band configuration.

Two exemplary embodiments for use of the pre-tensioned resistance band assembly 130 are presented in FIGS. 6 and 7, the embodiments include:

(a) A parallel arranged pre-tensioned elastic resistance assembly 150 coupling a plurality of pre-tensioned resistance band assembly 130 in parallel and (b) A serially arranged pre-tensioned elastic resistance assembly 160 coupling a plurality of pre-tensioned resistance band assembly 130 in series.

The parallel arranged pre-tensioned elastic resistance assembly 150 doubles the net work performed during each exercise repetition by doubling the resistive force per unit distance elongated. The serially arranged pre-tensioned elastic resistance assembly 160 doubles the net work performed during each exercise repetition by doubling the total distance elongated. By adding multiple parallel bands of pre-tensioned resistance band assembly 130, you can set the resistance value desired for the each particular exercise. The parallel arranged pre-tensioned elastic resistance assembly 150 couples to pre-tensioned resistance band assembly 130 in a parallel configuration, coupling each of the two ends together via the connecting ring 124. An elastic band 110,112 is then coupled to each connecting ring 124 and oriented projecting away from the parallel arranged pre-tensioned elastic resistance assembly 150. It would be preferred that the length of each of the pre-tensioned resistance band assembly 130 located in parallel would be the same length. Should the plurality of pre-tensioned resistance band assembly 130 differ in length, it is recognized that a compensating coupling device can be utilized. The serially arranged pre-tensioned elastic resistance assembly 160 couples to pre-tensioned resistance band assembly 130 in a serial configuration, coupling each band pre-tensioned resistance band assembly 130 end to end via the connecting ring 124. It is also recognized that the two configurations can be combined within a single exercise band 100. By combining the various form factors of the elastic resistance material, one can "tune" the overall exercise. One can combine several pre-tensioned resistance band assemblies 130, each having a different resistance, or combine a pre-tensioned resistance band assembly 130 with a non pre-tensioned resistance band 112, and the like.

Figure 8:
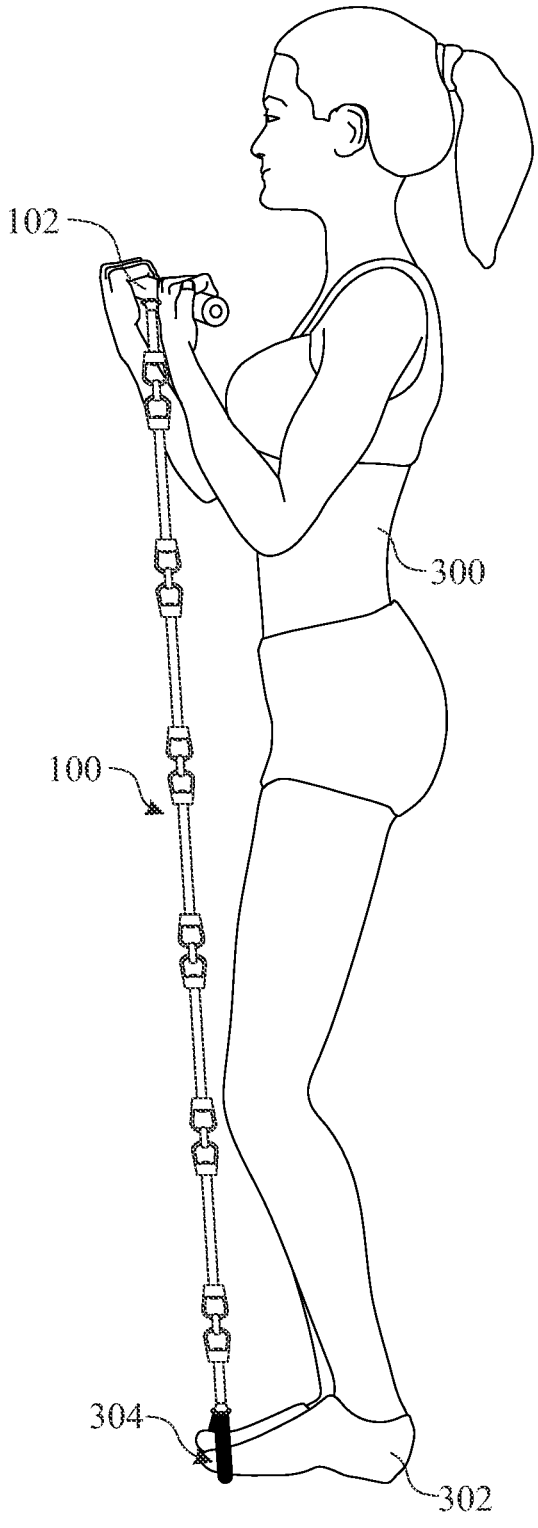
FIG. 8 presents a side view of a person using the linear resistance exercise band.

A user 300 exercising with the linear elastic resistance band 100 is illustrated in FIG. 8. The user 300 holds the band handle 102 of the linear elastic resistance band 100 and secures the opposite end by placing their user's foot 302 through a foot interface 304.

Figure 9:
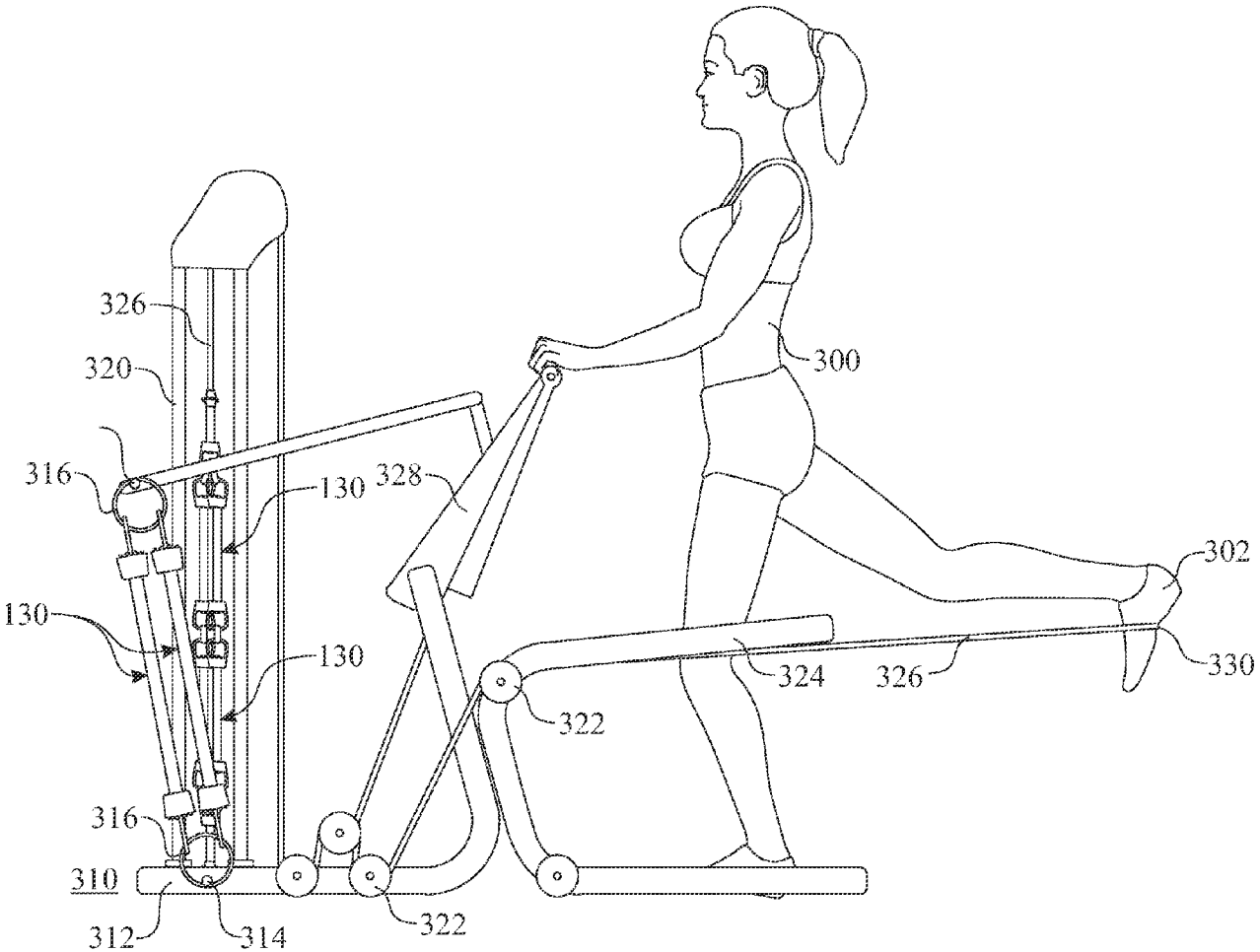
FIG. 9 presents a side view of a person using a mechanical exercise station incorporating linear resistance exercise bands.

A user 300 exercising with a resistance operated exercise station 310 is illustrated in FIG. 9; the resistance operated exercise station 310 utilizing a plurality of pre-tensioned resistance band assembly 130 to provide the resistance forces. The pre-tensioned resistance band assembly 130 can be utilized for both upper body and lower body workouts. A pair of pre-tensioned resistance band assembly 130 is fastened via a band coupling ring 316 at each end, to a respective resistance band attachment member 314. The resistance force is conveyed to an upper body exercise station 328 for the user's upper body exercises. Additional sections of pre-tensioned resistance band assembly 130 are integrated into a pulley system, being coupled between an exercise station base 312 and an exercise cable 326 within an exercise station vertical resistance frame 320. The exercise cable 326 is then routed via a plurality of pulley system 322 about the top of the exercise station vertical resistance frame 320, then along the exercise station base 312 and lower body exercise station 324 terminating at the user's foot 302. The user inserts their user's foot 302 into a foot loop 330; the foot loop 330 being fastened to the distal end of the exercise cable 326. The resistance operated exercise station 310 can utilize any configuration of pre-tensioned resistance band assembly 130 presented herein, such as the parallel arranged pre-tensioned elastic resistance assembly 150, the serially arranged pre-tensioned elastic resistance assembly 160, or any combination therein.

Figure 10:
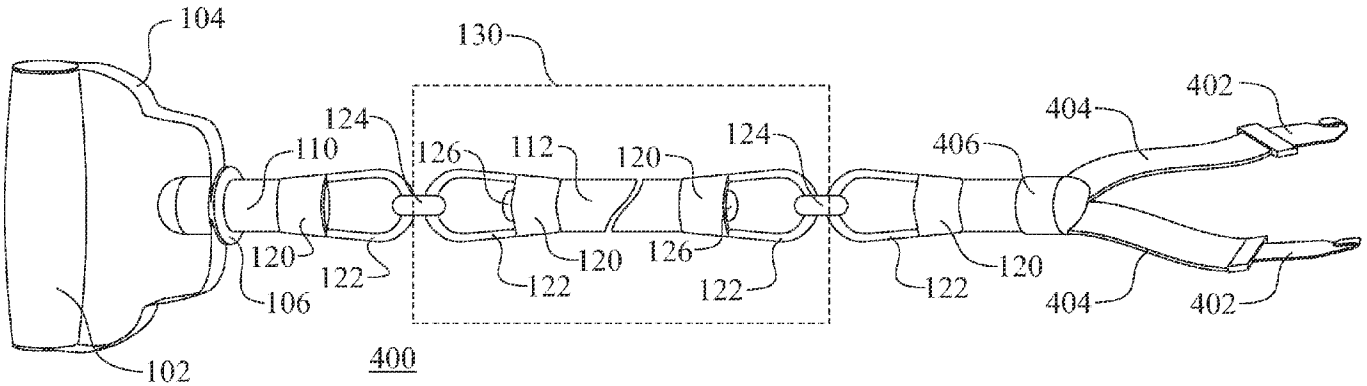
FIG. 10 presents yet another embodiment of an elastic resistance band utilizing hooks and a length adjusting strap.
Figure 11:
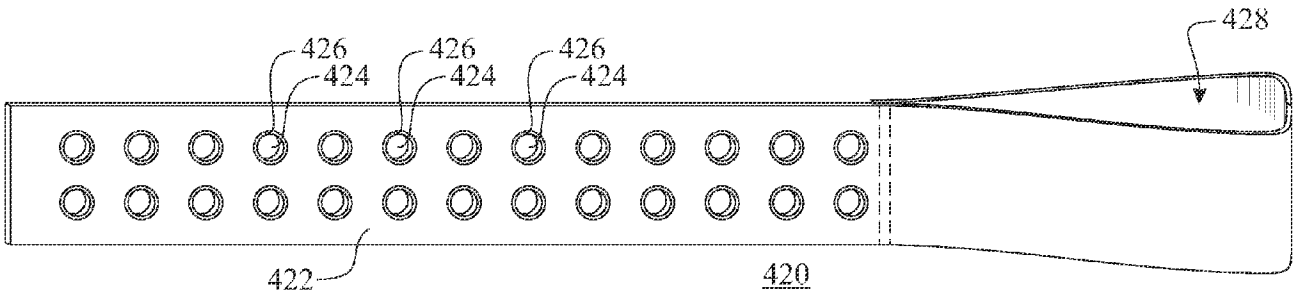
FIG. 11 presents the length adjusting strap for use with the elastic resistance band illustrated in FIG. 11.

An additional feature of the present invention is presented in FIG. 10, wherein the pre-tensioned resistance band assembly 130 is incorporated into a length adjusting elastic resistance band 400. The length adjusting elastic resistance band 400 comprising the features of linear elastic resistance band 100, replacing one handle with at least one band clip(s) 402. Each band clip(s) 402 is fastened to a band clip strap(s) 404, which is secured to the end of the linear elastic resistance band 100 via a band clip coupler 406. The length adjusting elastic resistance band 400 is used in conjunction with a length adjusting strap 420 presented in FIG. 11. The length adjusting strap 420 is fabricated from a strap base material 422, incorporating a strap securing loop 428 at one end and having a plurality of strap coupling apertures 424 along the body towards the opposing end. The strap base material 422 can be of any material, including canvas, leather, nylon, and the like. The strap coupling apertures 424 can optionally be reinforced via strap aperture reinforcements 426 as desired. The band clip(s) 402 of length adjusting elastic resistance band 400 can be inserted into the strap coupling apertures 424 of length adjusting strap 420 providing the user with the ability to adjust the overall length of the exercise band. The strap securing loop 428 can include a "C" shaped cutout (not shown) for securing the end to a door handle or other object.

Figure 12:
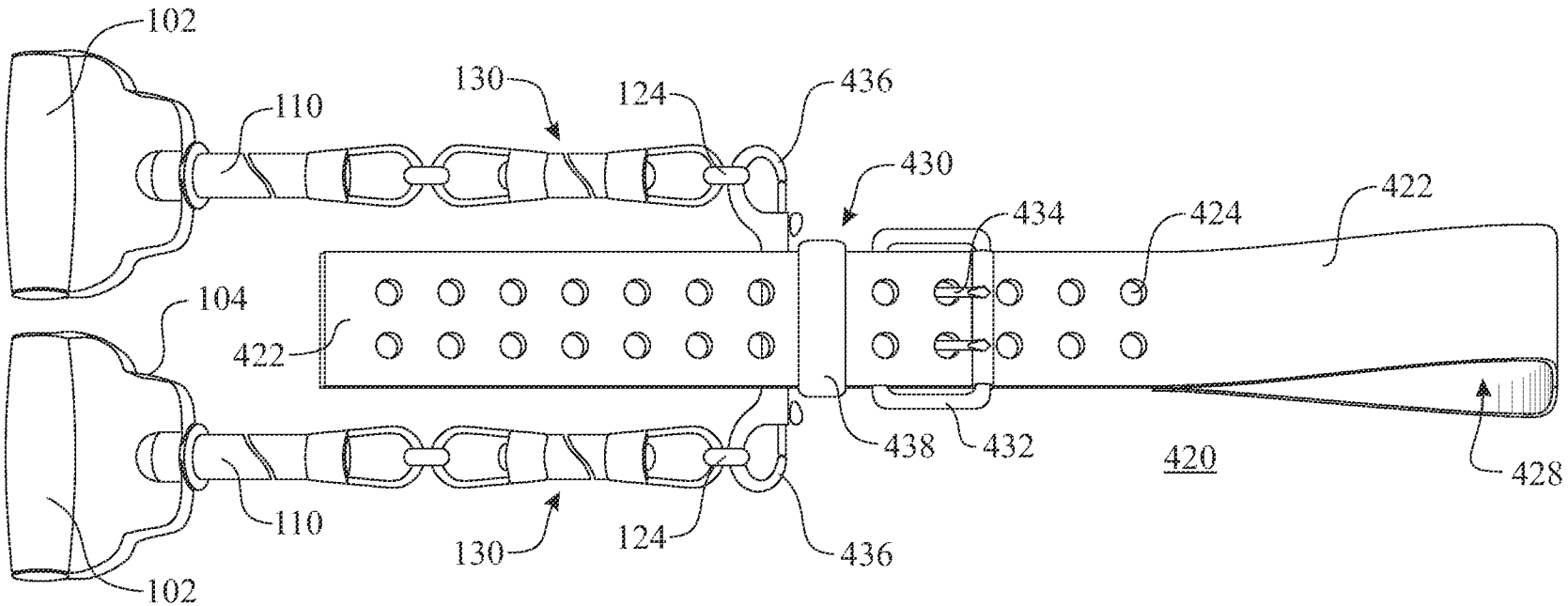
FIG. 12 presents the length adjusting strap combined with a dual resistance band coupling buckle.

A modified connecting scheme is presented in FIG. 12, replacing the band clip(s) 402 with a buckle-band connecting clips 436. An adjusting strap buckle assembly 430 is utilized for coupling the pre-tensioned resistance band assembly 130 to the length adjusting strap 420. A strap loop 438 would be slid over the strap base material 422. The adjusting strap buckle assembly 430 consists of an adjusting strap buckle 432 and respective adjusting strap buckle prongs 434, wherein the adjusting strap buckle prongs 434 would be placed through the strap coupling apertures 424 affixing the adjusting strap buckle assembly 430 to the length adjusting strap 420. The buckle-band connecting clips 436 are assembled to the adjusting strap buckle assembly 430 providing a means for removably attaching the pre-tensioned resistance band assembly 130.

Figure 13:
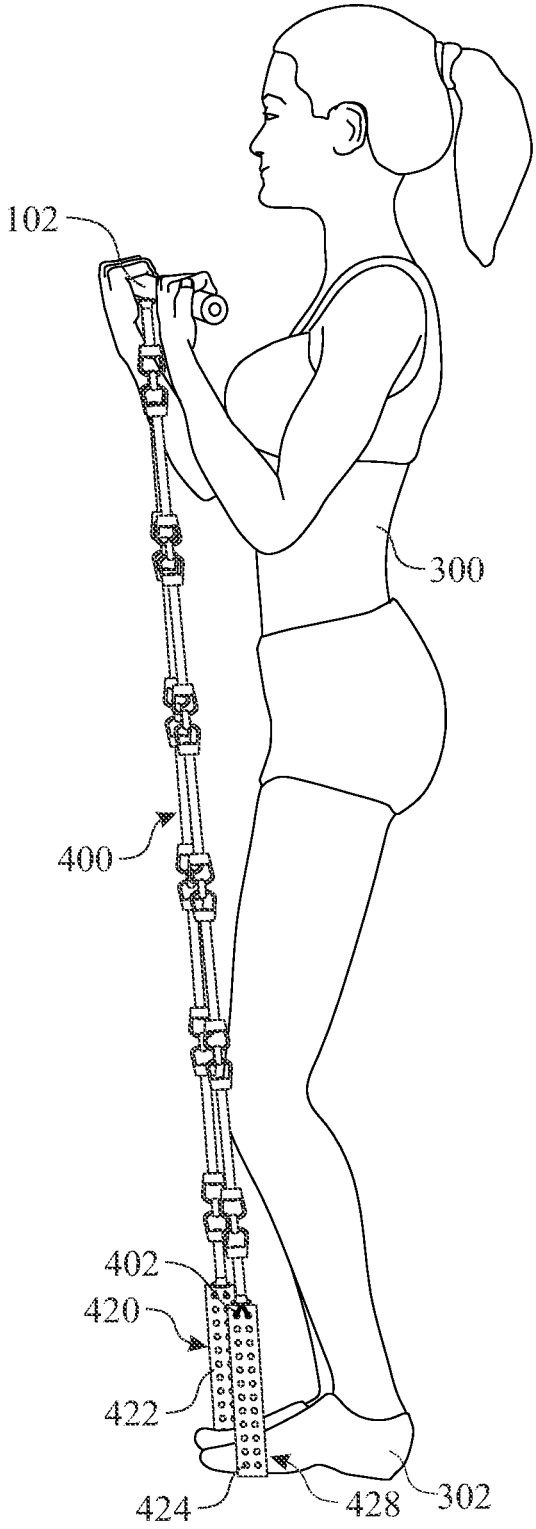
FIG. 13 presents the length adjusting strap and respective elastic resistance band configuration of FIGS. 10 through 12 illustrated in use.

An exemplary application of the length adjusting strap 420 is presented in FIG. 13, wherein the user 300 would secure the length adjusting elastic resistance band 400 to the length adjusting strap 420 via placing the band clip(s) 402 into the strap coupling apertures 424 setting a desiring length of the overall exercise band. The user 300 then would place their user's foot 302 into the strap securing loop 428, hold the band handle 102 and exercise accordingly.

Figure 14:
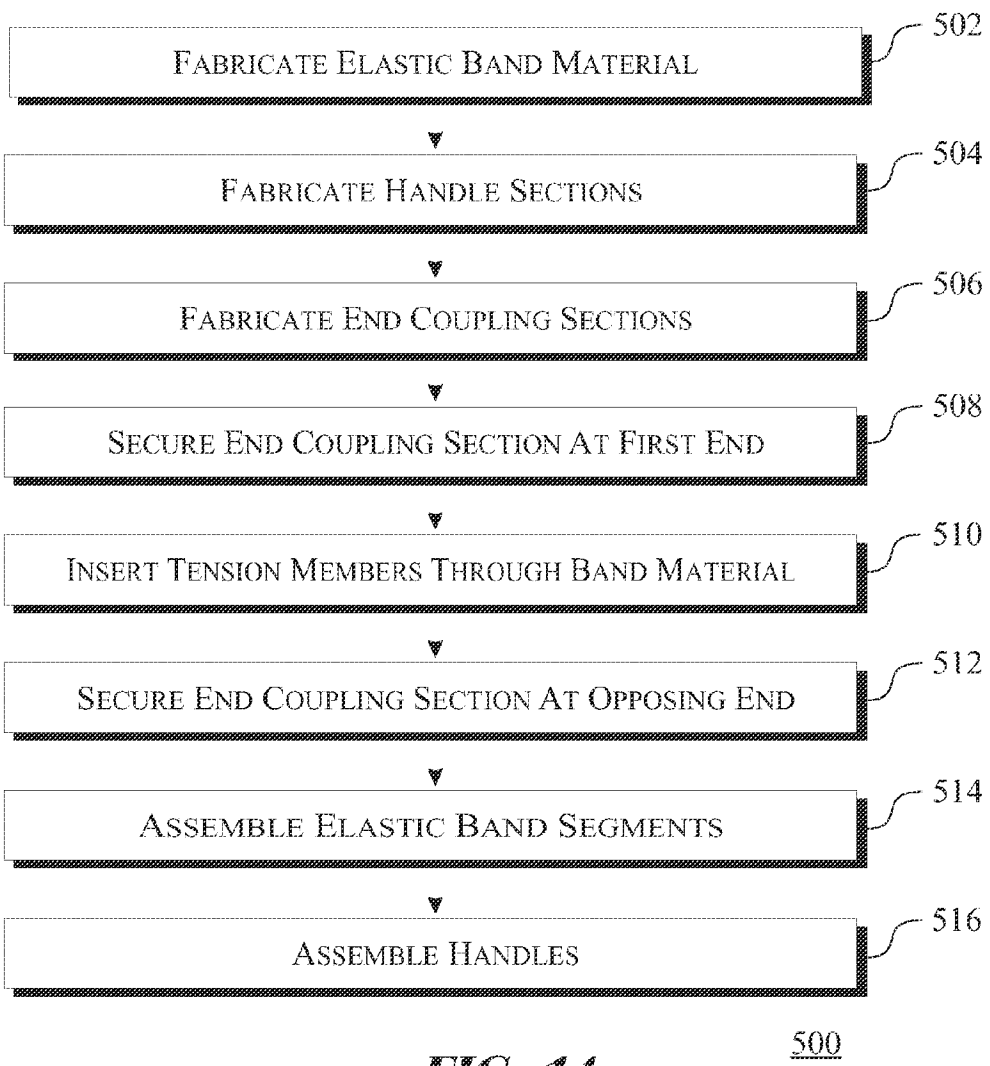
FIG. 14 presents a linear resistance band fabrication flow diagram.
Figure 15:
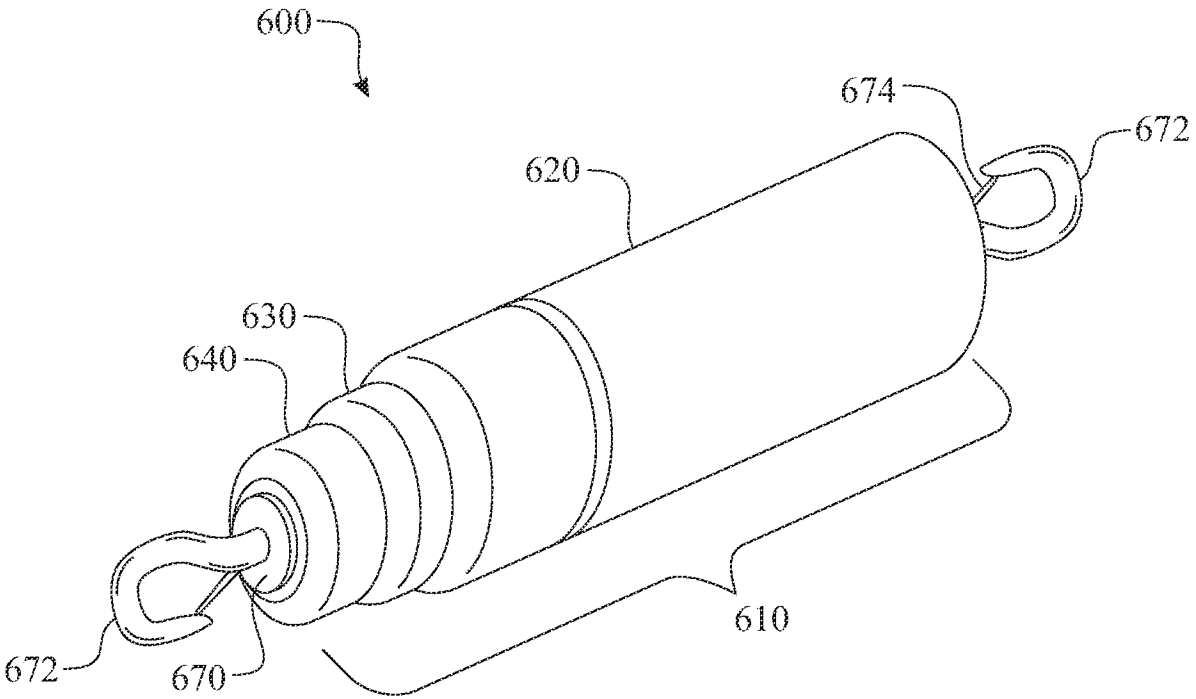
FIG. 15 presents an isometric view of an exemplary telescoping pre-tensioned resistance exercise assembly illustrated in a collapsed configuration.
Figure 16:
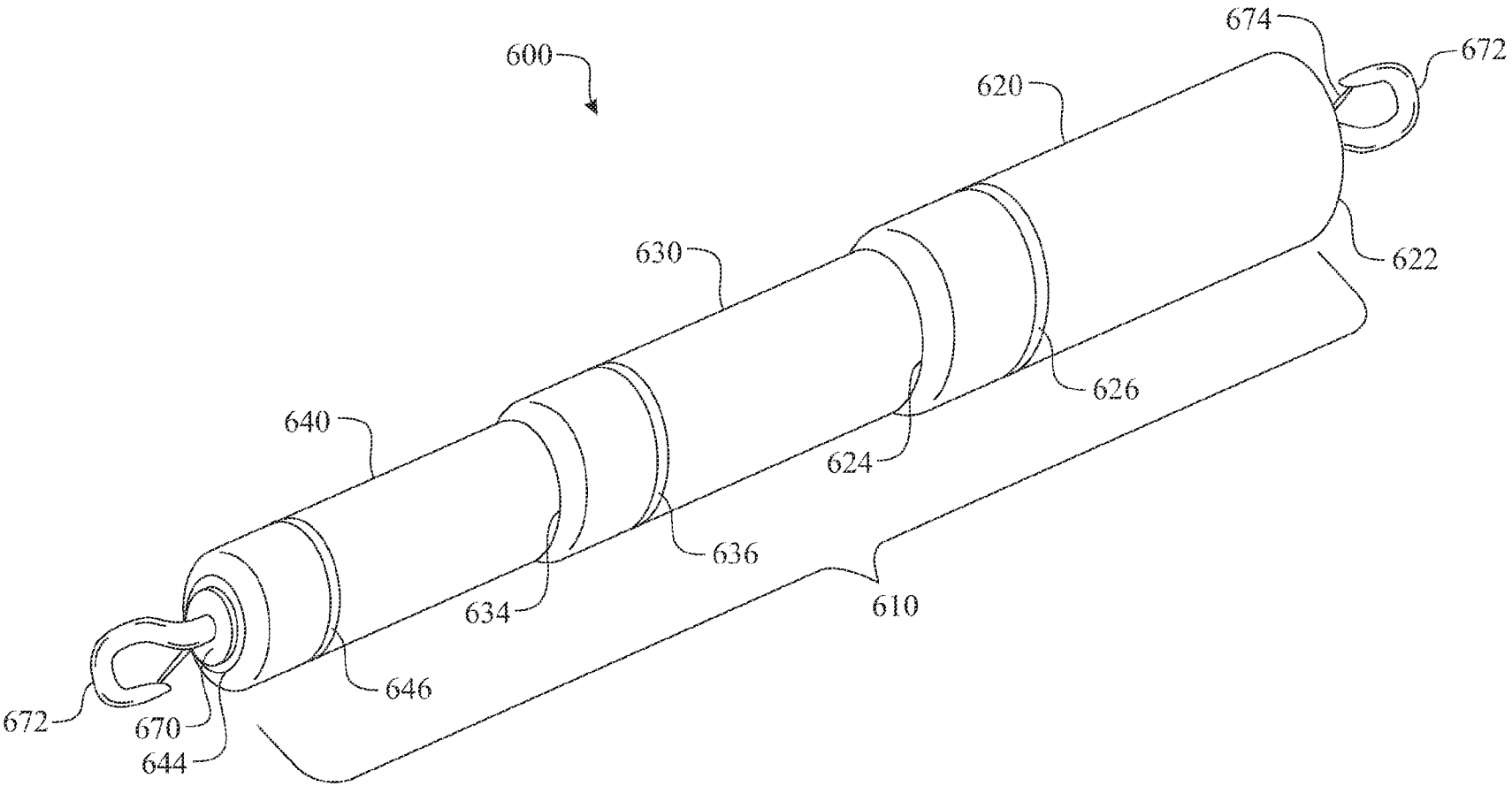
FIG. 16 presents an isometric view of an exemplary telescoping pre-tensioned resistance exercise assembly originally introduced in FIG. 15, the assembly being illustrated in an expanded configuration.
Figure 17:
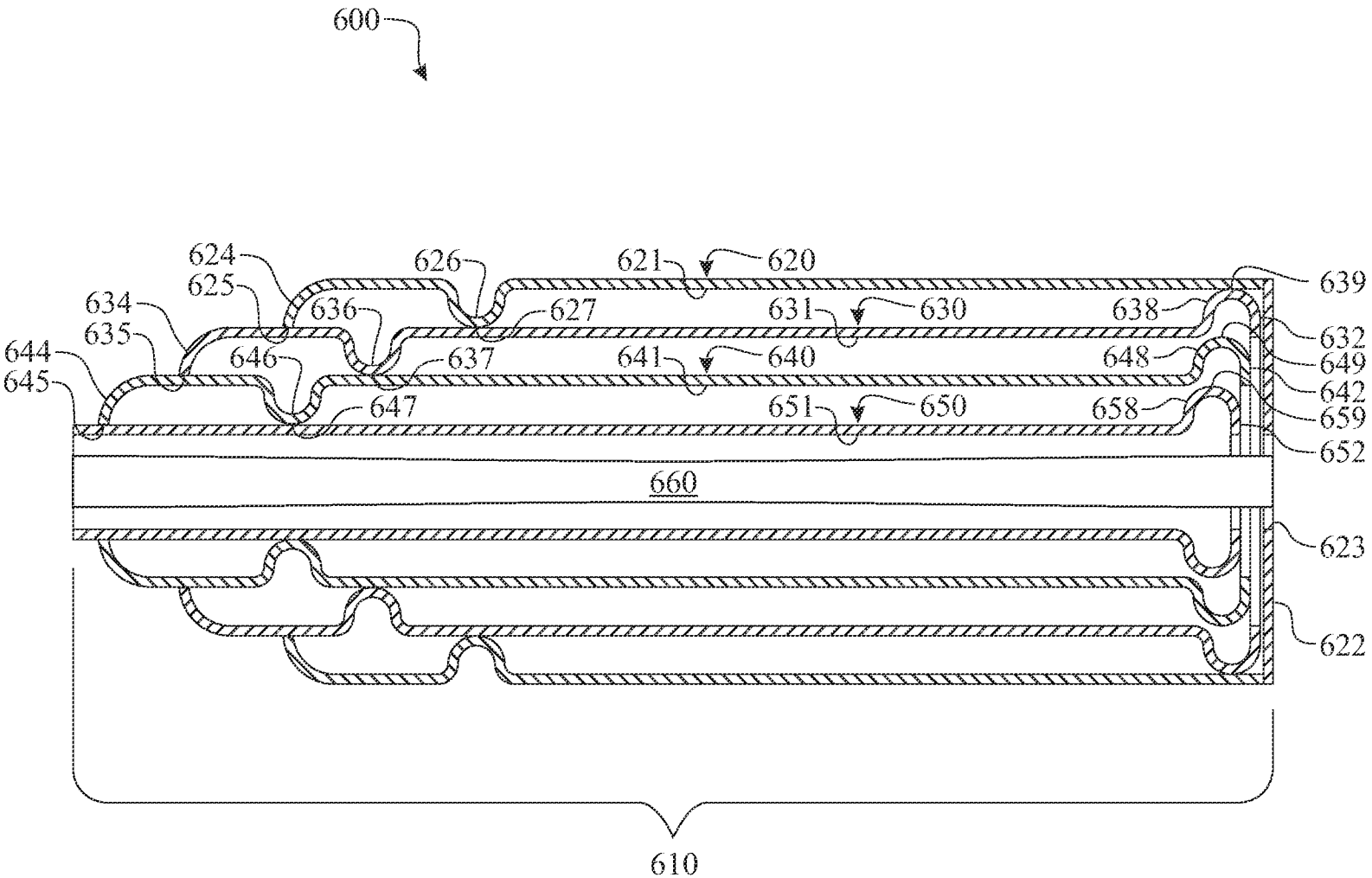
FIG. 17 presents a cross sectional view of the exemplary telescoping pre-tensioned resistance exercise assembly originally introduced in FIG. 15, the section is illustrated in a collapsed configuration with the section being taken through a longitudinal axis of the assembly.
Figure 18:
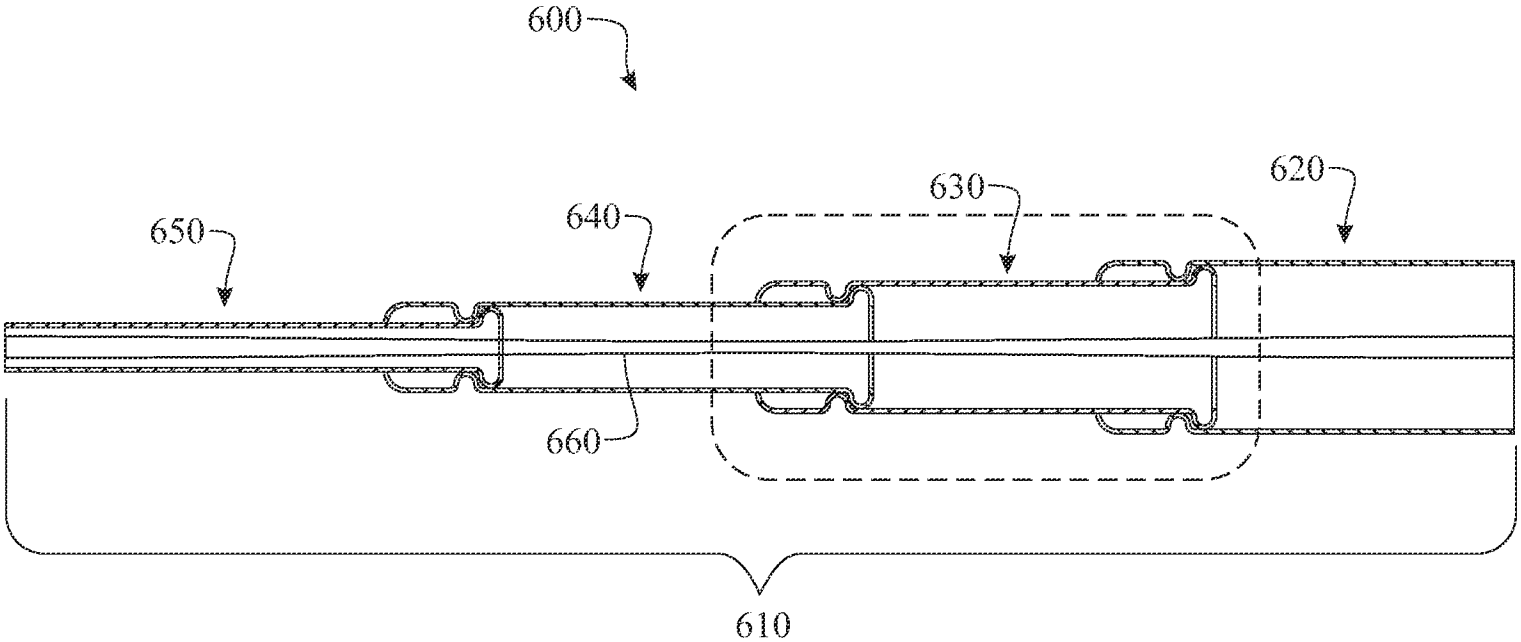
FIG. 18 presents a cross sectional view of the exemplary telescoping pre-tensioned resistance exercise assembly originally introduced in FIG. 15, the section is illustrated in an extended configuration with the section being taken through a longitudinal axis of the assembly.
Figure 19:
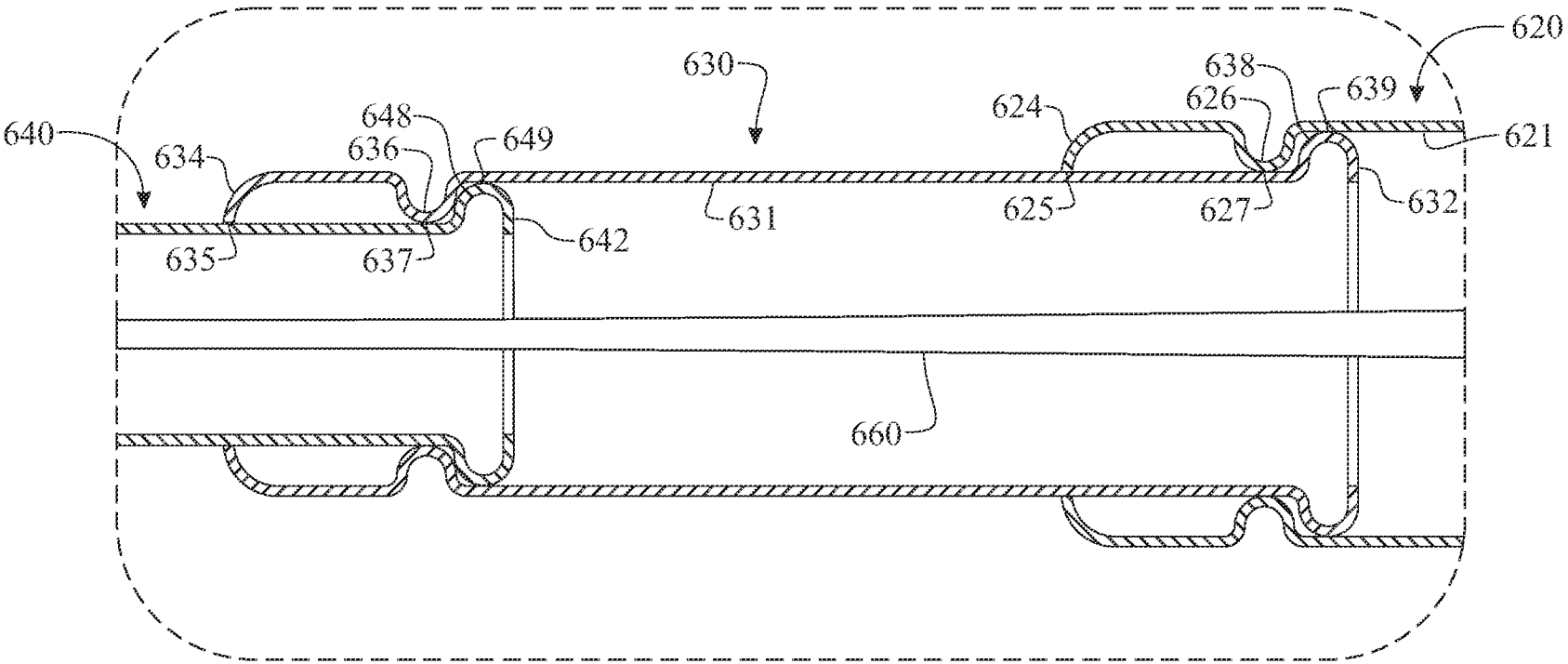
FIG. 19 presents an enlarged, detailed cross sectional view of a section of the exemplary telescoping pre-tensioned resistance exercise assembly originally introduced in FIG. 15, the section is illustrated in an extended configuration with the section being taken through a longitudinal axis of the assembly.

A pre-tensioned resistance band fabrication flow diagram 500 is presented in FIG. 14. The pre-tensioned resistance band fabrication flow diagram 500 initiates with an elastic band material fabrication step 502, wherein the elastic banding material is formed and cut to length. The elastic band material can be fabricated via an extrusion process. The handle sections are fabricated in accordance with a handle fabrication step 504. The handles can be fabricated of metal, plastic, wood, and the like. The handles can be covered with a soft material such as foam, rubber, fabric, or any other cushioning material. The band coupling members are fabricated in accordance with an end coupling section fabrication step 506. The end coupling members can be fabricated via common injection molding processes. It is recognized that any form factor can be utilized, as long as the form factor meets the requirements of the design. The end coupling members provide three features: 1) securing the elastic material, 2) coupling between elastic section assemblies, and 3) receiving the pre-tensioning force. The first end coupling member is assembled to a first end of the resistance band material as presented in a secure first end coupling section step 508. The tension member is fabricated, cut to length, and assembled about the band material as described by a tension member fabrication and insertion step 510. The tension members are fabricated of a non-compressible material such as metal, plastic, and the like. The tension members can be either solid and placed within a hollowed section of the band material or hollow and placed over the band material. Once the tension member is placed into position, the elastic band is stretched, applying a pre-set tension to the band material. Another end coupling member is secured to the opposing end fixing the pre-applied tension, as presented via a second end coupling member assembly step 512.

An enhancement to the externally supported pre-tension resistance band assembly 140 is referred to as a telescoping pre-tensioned resistance exercise assembly 600. The telescoping pre-tensioned resistance exercise assembly 600 is detailed in FIGS. 15 through 19. The external tension tube 142 is enhanced using a telescoping assembly 610. The telescoping assembly 610 comprises a series of telescoping members 620, 630, 640, 650. It is understood that the telescoping assembly 610 can include two or more members arranged in a telescoping configuration. The exemplary embodiment illustrated includes four telescoping members 620, 630, 640, 650 which can be referred to as a first telescoping member 620, a second telescoping member 630, third telescoping member 640, and continuing with any quantity of telescoping members, an nth telescoping member 650. The exemplary embodiment presents one known telescoping configuration. It is understood that any known telescoping configuration can be utilized while maintaining the spirit and intent of the present invention.

The telescoping members 620, 630, 640, 650 contain a plurality of like features. Like features of each telescoping members 620, 630, 640, 650 are numbered the same pairing the prefix "62", "63", "64", "65" with a like suffix, where the prefix defines the respective telescoping member and the suffix defines the respective feature. The outer member, or first telescoping member 620, is fabricated of a tubular structure defined by a first telescoping member interior wall 621 and an opposite respective exterior surface indicated by the arrow of reference first telescoping member 620. The first telescoping member 620 includes a first telescoping member extension end wall 624 formed at an extension end of the member and a collapsing end wall aperture 623 either formed or subsequently attached at a collapsing end of the member. An expansion end wall aperture 625 is provided through the first telescoping member extension end wall 624. A first telescoping member control groove 626 is preferably formed about a circumference of the tubular structure of the first telescoping member 620, wherein a groove interior surface 627 forms an interior diameter that is similar to an interior diameter of the expansion end wall aperture 625. The first telescoping member control groove 626 is located at a position enabling extension of an internally assembled telescoping member 630, while maintaining axial rigidity of the assembly.

Each internally located member 630, 640, 650 may include a telescoping member retention flange 638, 648, 659 respectively at a collapsing end thereof. Each telescoping member retention flange 638, 648, 659 may be formed to position a telescoping member retention flange exterior surface 639, 649, 659 forming a peripheral diameter generally equal to the interior diameter of the adjacent telescoping member 620, 630, 640, respectively. Each retention flange may be shaped in a semi-circular shape, forming a telescoping member collapsing end wall 632, 642, 652, respectively. The telescoping member collapsing end wall 632, 642, 652 would abut an adjacent element to limit a collapsing motion. It is understood that the telescoping member retention flange 638, 648, 659 can alternately be a compression ring assembled within a groove, wherein the compression ring can be compressed during an assembly process to pass across a feature having a smaller internal diameter, such as the expansion end wall aperture 625, 635, 645. The compression ring would then expand to a diameter that retains the internal telescoping member 630, 640, 650 within the assembly, wherein the compression ring would mechanical interfere with the telescoping member control groove 626, 636, 646 of the adjacent telescoping member 620, 630, 640.

The telescoping assembly 610 is assembled by slidably engaging each of the telescoping members 620, 630, 640, 650 sequentially together through a collapsing end thereof. The collapsing end wall aperture 623 is subsequently assembled to the first telescoping member 620, retaining the internally assembled telescoping members 630, 640, 650, therein. Each telescoping member retention flange 638, 648, 658 of each respective internally assembled telescoping member 630, 640, 650 is entrapped between the respective telescoping member control groove 626, 636, 646 of the adjacent telescoping member 620, 630, 640 and the collapsing end wall aperture 623. When the telescoping assembly 610 is fully extended, the motion of the internally assembled telescoping members 630, 640, 650 are limited by the mechanical interference between the telescoping member retention flange exterior surface 639, 649, 659 of the telescoping member retention flange 638, 648, 658, respectively and the groove interior surface 627, 637, 647 of the telescoping member control groove 626, 636, 646, respectively. Longitudinal control of the sliding motion is governed by the telescoping member retention flange exterior surface 639, 649, 659 slideably engaging with the interior surface 621, 631, 641 of the adjacent telescoping member 620, 630, 640. Further longitudinal control of the sliding motion is governed by the expansion end wall aperture 625, 635, 645 slideably engaging with the exterior surface of the adjacent interior telescoping member 630, 640, 650. Additional longitudinal control of the sliding motion is governed by the groove interior surface 627, 637, 647 slideably engaging with the exterior surface of the adjacent interior telescoping member 630, 640, 650. The location of each of the respective interfaces can be positioned to ensure that at least two registration points remain in contact during the entire extension and collapsing motions.

A resistance band 660 is assembled through an internally created cavity of the telescoping assembly 610. A band coupling member 670, 690 can be attached to each end of the resistance band 660. A pre-applied tensile force is applied during the assembly process. It is preferred that the pre-applied tensile force is repeatably created during the assembly process for repeatable performance. The pre-applied tensile force is retained by the collapsed configuration of the telescoping assembly 610. As the telescoping assembly 610 is extended in accordance with an applied tensile force, the resistance band 660 creates a resistive force in accordance with the force illustrated in the exemplary force-distance diagram of FIG. 5.

Figure 20:
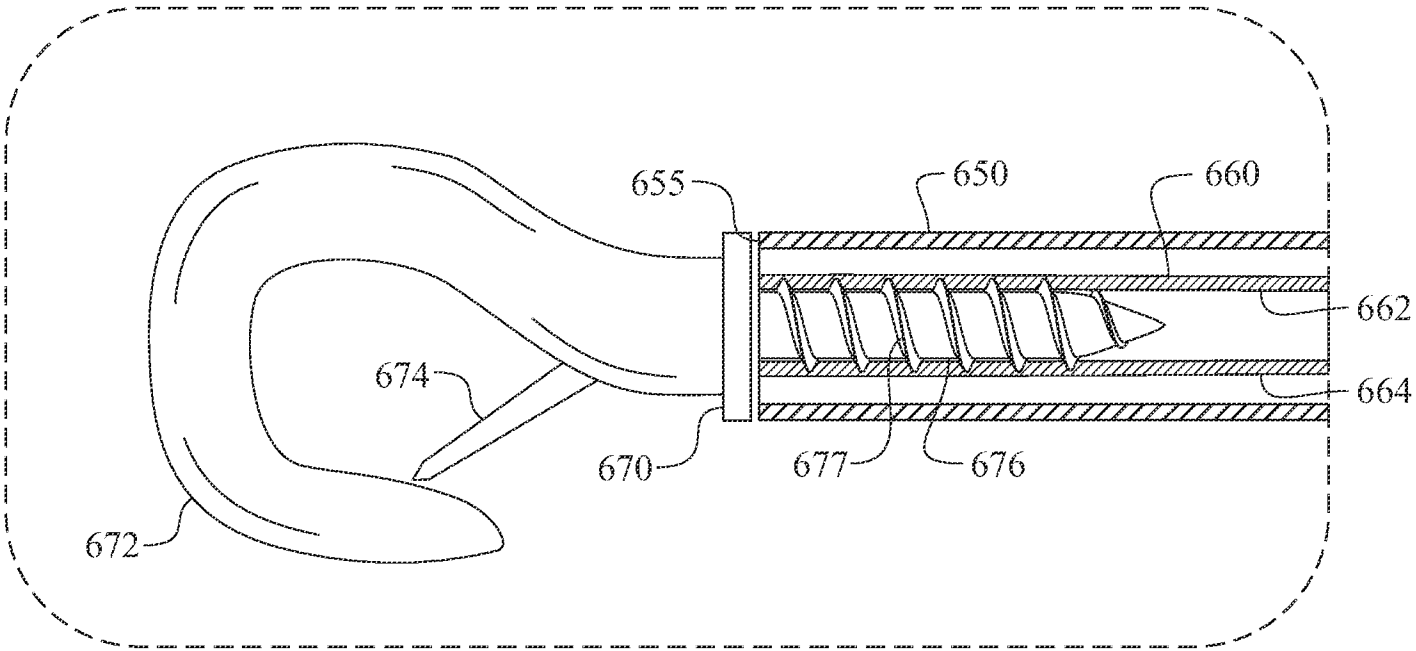
FIG. 20 presents a cross sectional view of a first exemplary band coupling member assembled to an end of a telescoping assembly.
Figure 21:
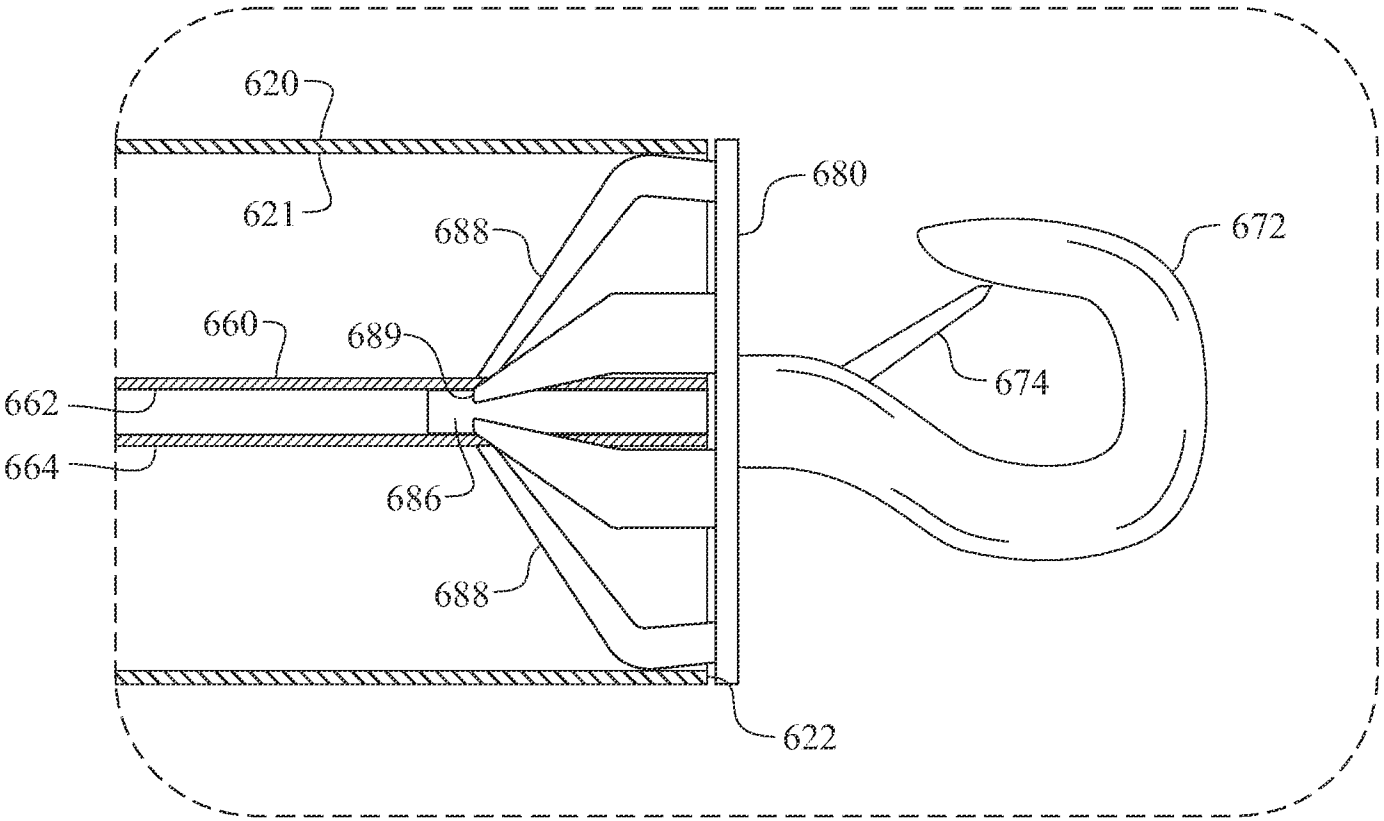
FIG. 21 presents a cross sectional view of a second exemplary band coupling member assembled to an end of a telescoping assembly.
Figure 22:
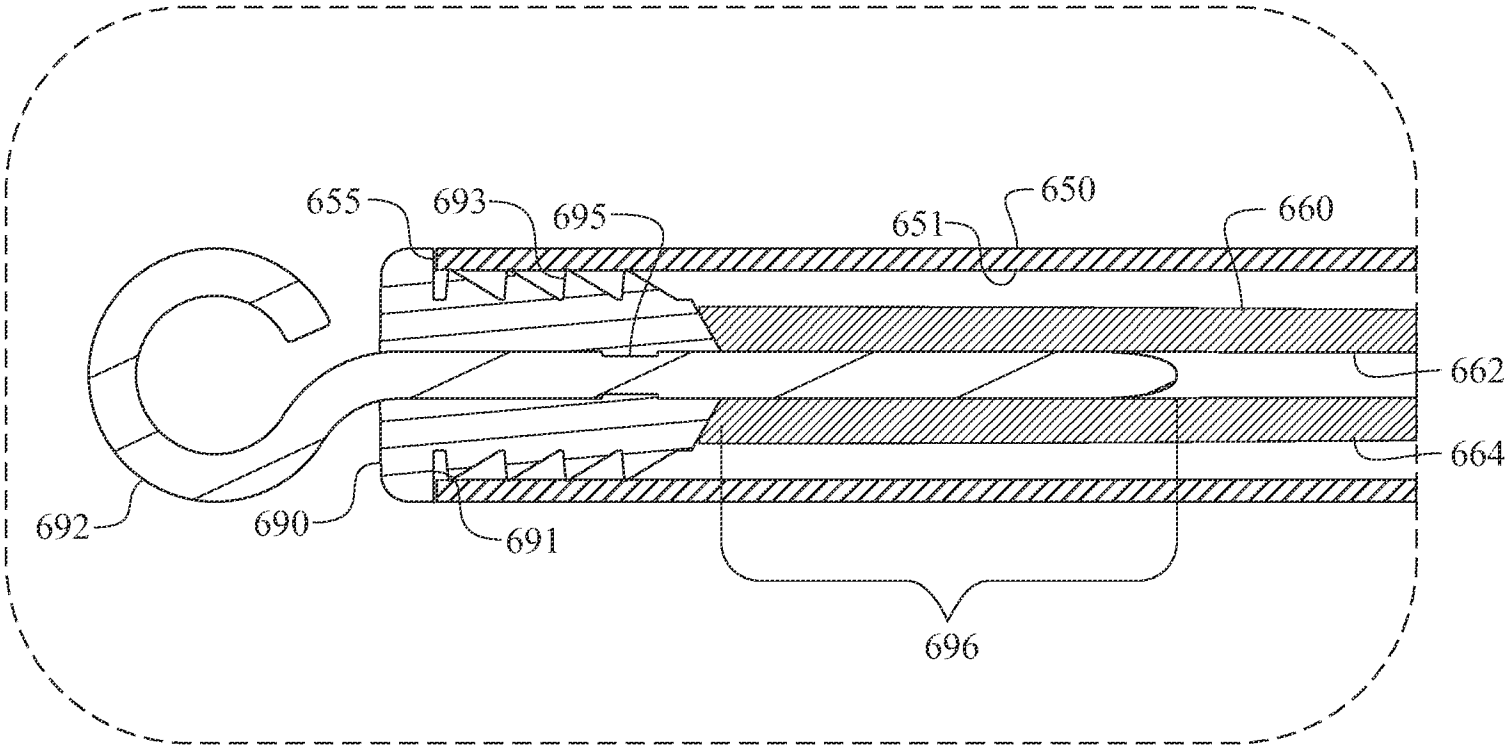
FIG. 22 presents a cross sectional view of a third exemplary band coupling member assembled to an end of a telescoping assembly.

The illustrated band coupling members 670, 690 present several exemplary embodiments, including those presented in FIGS. 20 through 22. It is understood that any band coupling interface can be utilized while maintaining the spirit and intent of the present invention.

A first exemplary band coupling member 670 includes a mounting flange, a band coupling loop 672 extending outward therefrom, and a coupling member attachment interface 676. An optional band coupling loop latch 674 may be included to retain a loop in engagement with the band coupling loop 672. The coupling member attachment interface 676 extends from the mounting flange in an opposing direction for attachment to the resistance band 660. The coupling member attachment interface 676 may include threads 677, barbs, and the like. The coupling member attachment interface 676 is inserted into a resistance band interior surface 662 of the resistance band 660. The mounting flange can seat against the expansion end wall aperture 655 of the nth telescoping member 650 (or similarly to the expansion end wall aperture 625 of the first telescoping member 620). Alternatively, the mounting flange can include features to engage with an interior surface, an exterior surface, or an expansion end wall aperture 655 of the nth telescoping member 650 for assembly thereto.

A second exemplary band coupling member, as illustrated in FIG. 21, includes a mounting flange 680, a band coupling loop 672 extending outward therefrom, and a coupling member plug element 686. An optional band coupling loop latch 674 may be included to retain a loop in engagement with the band coupling loop 672. The coupling member plug element 686 extends from the mounting flange in an opposing direction for attachment to the resistance band 660. The coupling member plug element 686 may be smooth or can include threads, barbs, and the like. The coupling member plug element 686 is inserted into a resistance band interior surface 662 of the resistance band 660. A series of coupling member grip finger 688 extend from an assembly side of the band coupling member end cap 680. The coupling member grip finger 688 are shaped to engage with a resistance band exterior surface 664 of the resistance band 660, compressing the resistance band 660 between a grip finger tip 689 and the coupling member plug element 686. A grip finger knee 687 of the coupling member grip finger 688 can engage with the first telescoping member interior wall 621 adjacent to the first telescoping member collapsing end wall 622, affixing the band coupling member end cap 680 to the first telescoping member 620. Alternatively, the mounting flange can include other features to engage with an interior surface, an exterior surface, or an expansion end wall aperture 655 of the nth telescoping member 650 for assembly thereto.

A third exemplary band coupling member combines a band coupling member and a respective assembly plug, as illustrated in FIG. 22, includes a mounting flange 690 including a coupling member assembly flange 691, a series of coupling member grip teeth 693 extending outward therefrom, and a linear segment of a band coupling loop 692 assembled therethrough. The band coupling loop 692 includes a loop section and a linear section. A loop retention recess 695 is formed within the linear section enhancing a mechanical interface between the band coupling member 690 and the band coupling loop 692. The band coupling member 690 is preferably molded over the band coupling loop 692 using an insertion molding process. The band coupling loop 692 includes a coupling member plug element 696 for attachment to the resistance band 660. The coupling member plug element 696 is inserted into the resistance band interior surface 662 of the resistance band 660. The coupling member plug element 696 can include mechanical latching features, including threading, barbs, a bulbous section, and the like. It is understood that the band coupling member 690 would be sized for each respective end of the telescoping assembly 610.

Those skilled in the art can recognize the band coupling loop 672, 692 can be of any reasonable shape for removably engaging with a handle assembly.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

The invention claimed is:

1. A telescoping pre-tensioned resistance exercise assembly, said exercise assembly comprising at least one band handle assembly and a pre-tensioned resistance band assembly, said pre-tensioned resistance band assembly comprising:

a rigid telescoping assembly including an external tubular telescoping member and at least one internal tubular telescoping member slideably assembled within an interior section of said external tubular telescoping member, a section of elastic resistance material located through said interior section of said tubular telescoping members;

a first end coupler secured to a first end of said section of elastic resistance material and in communication with a first end of said rigid telescoping assembly;

a second end coupler secured to a second end of said section of elastic resistance material and in communication with a second end of said rigid telescoping assembly; and wherein said rigid telescoping assembly applies a pre-tensioning force to said elastic resistance material and said elastic resistance material applies a compression force to said rigid telescoping assembly, whereby when said elastic resistance material is stretched, said compression force applied to said rigid member is removed.

2. A telescoping pre-tensioned resistance exercise assembly as recited in claim 1, wherein said first end coupler is mechanically coupled to said rigid telescoping assembly first end and said second end coupler is mechanically coupled to said rigid telescoping assembly second end.

3. A telescoping pre-tensioned resistance exercise assembly as recited in claim 1, said external tubular telescoping member further comprising a telescoping member extension end wall having an expansion end wall aperture, wherein said expansion end wall aperture is sized and shaped to slideaby mate with an exterior surface of an adjacent internal tubular telescoping member.

4. A telescoping pre-tensioned resistance exercise assembly as recited in claim 3, said external tubular telescoping member further comprising a telescoping member control groove located at a distance from said expansion end wall aperture, said telescoping member control groove having a groove interior surface, wherein said groove interior surface is sized and shaped to slideaby mate with said exterior surface of an adjacent internal tubular telescoping member.

5. A telescoping pre-tensioned resistance exercise assembly as recited in claim 4, each said internal tubular telescoping member further comprising a retention flange extending outward from a collapsing end thereof, wherein said retention flange provides a mechanical interference with said groove interior surface, thus retaining said internal tubular telescoping member within the assembly.

6. A telescoping pre-tensioned resistance exercise assembly as recited in claim 5, said retention flange further comprising a retention flange exterior surface, wherein said retention flange exterior surface is sized and shaped to slideaby mate with an interior surface of an adjacent externally arranged tubular telescoping member.

7. A telescoping pre-tensioned resistance exercise assembly as recited in claim 1, said external tubular telescoping member further comprising a telescoping member collapsing end wall, wherein said collapsing end wall retains said internal tubular telescoping members within said exercise assembly.

8. A telescoping pre-tensioned resistance exercise assembly, said exercise assembly comprising at least one band handle assembly and a pre-tensioned resistance band assembly, said pre-tensioned resistance band assembly comprising:

a rigid telescoping assembly including an external cylindrical telescoping member and at least one internal cylindrical telescoping member slideably assembled within an interior section of said external cylindrical telescoping member, a section of elastic resistance material located through said interior section of said cylindrical telescoping members;

a first end coupler secured to a first end of said section of elastic resistance material and in communication with a first end of said rigid telescoping assembly;

a second end coupler secured to a second end of said section of elastic resistance material and in communication with a second end of said rigid telescoping assembly; and wherein said rigid telescoping assembly applies a pre-tensioning force to said elastic resistance material and said elastic resistance material applies a compression force to said rigid telescoping assembly, whereby when said elastic resistance material is stretched, said compression force applied to said rigid member is removed.

9. A telescoping pre-tensioned resistance exercise assembly as recited in claim 8, wherein said first end coupler is mechanically coupled to said rigid telescoping assembly first end and said second end coupler is mechanically coupled to said rigid telescoping assembly second end.

10. A telescoping pre-tensioned resistance exercise assembly as recited in claim 8, said external cylindrical telescoping member further comprising a telescoping member extension end wall having an expansion end wall aperture, wherein said expansion end wall aperture is sized and shaped to slideaby mate with an exterior surface of an adjacent internal cylindrical telescoping member.

11. A telescoping pre-tensioned resistance exercise assembly as recited in claim 10, said external cylindrical telescoping member further comprising a telescoping member control groove located at a distance from said expansion end wall aperture, said telescoping member control groove having a groove interior surface, wherein said groove interior surface is sized and shaped to slideaby mate with said exterior surface of an adjacent internal cylindrical telescoping member.

12. A telescoping pre-tensioned resistance exercise assembly as recited in claim 11, each said internal cylindrical telescoping member further comprising a retention flange extending outward from a collapsing end thereof, wherein said retention flange provides a mechanical interference with said groove interior surface, thus retaining said internal cylindrical telescoping member within the assembly.

13. A telescoping pre-tensioned resistance exercise assembly as recited in claim 12, said retention flange further comprising a retention flange exterior surface, wherein said retention flange exterior surface is sized and shaped to slideaby mate with an interior surface of an adjacent externally arranged cylindrical telescoping member.

14. A telescoping pre-tensioned resistance exercise assembly as recited in claim 8, said external cylindrical telescoping member further comprising a telescoping member collapsing end wall, wherein said collapsing end wall retains said internal cylindrical telescoping members within said exercise assembly.

15. A telescoping pre-tensioned resistance exercise assembly, said exercise assembly comprising at least one band handle assembly and a pre-tensioned resistance band assembly, said pre-tensioned resistance band assembly comprising:

a rigid telescoping assembly including an external cylindrical telescoping member and at least one internal cylindrical telescoping member slideably assembled within an interior section of said external cylindrical telescoping member, a section of elastic resistance material located through said interior section of said cylindrical telescoping members;

a first end coupler comprising a handle assembly receiving feature, said first end coupler secured to a first end of said section of elastic resistance material and in communication with a first end of said rigid telescoping assembly;

a second end coupler comprising a handle assembly receiving feature, said second end coupler secured to a second end of said section of elastic resistance material and in communication with a second end of said rigid telescoping assembly; and wherein said rigid telescoping assembly applies a pre-tensioning force to said elastic resistance material and said elastic resistance material applies a compression force to said rigid telescoping assembly, whereby when said elastic resistance material is stretched, said compression force applied to said rigid member is removed.

16. A telescoping pre-tensioned resistance exercise assembly as recited in claim 15, wherein said first end coupler is mechanically coupled to said rigid telescoping assembly first end and said second end coupler is mechanically coupled to said rigid telescoping assembly second end.

17. A telescoping pre-tensioned resistance exercise assembly as recited in claim 15, said external cylindrical telescoping member further comprising a telescoping member extension end wall having an expansion end wall aperture, wherein said expansion end wall aperture is sized and shaped to slideaby mate with an exterior surface of an adjacent internal cylindrical telescoping member.

18. A telescoping pre-tensioned resistance exercise assembly as recited in claim 17, said external cylindrical telescoping member further comprising a telescoping member control groove located at a distance from said expansion end wall aperture, said telescoping member control groove having a groove interior surface, wherein said groove interior surface is sized and shaped to slideaby mate with said exterior surface of an adjacent internal cylindrical telescoping member.

19. A telescoping pre-tensioned resistance exercise assembly as recited in claim 18, each said internal cylindrical telescoping member further comprising a retention flange extending outward from a collapsing end thereof, wherein said retention flange provides a mechanical interference with said groove interior surface, thus retaining said internal cylindrical telescoping member within the assembly.

20. A telescoping pre-tensioned resistance exercise assembly as recited in claim 19, said retention flange further comprising a retention flange exterior surface, wherein said retention flange exterior surface is sized and shaped to slideaby mate with an interior surface of an adjacent externally arranged cylindrical telescoping member.

* * * * *